US011793252B1

(12) United States Patent
Kaufman

(10) Patent No.: US 11,793,252 B1
(45) Date of Patent: Oct. 24, 2023

(54) COLLARED GARMENT WITH CONCEALED DEPLOYABLE FACE MASK

(71) Applicant: Michael G. Kaufman, Beachwood, OH (US)

(72) Inventor: Michael G. Kaufman, Beachwood, OH (US)

(73) Assignee: Kaufman Apparel Group LLC, Beachwood, OH (US)

( * ) Notice: Subject to any disclaimer, the term of this patent is extended or adjusted under 35 U.S.C. 154(b) by 0 days.

(21) Appl. No.: 17/363,616

(22) Filed: Jun. 30, 2021

Related U.S. Application Data

(60) Provisional application No. 63/056,894, filed on Jul. 27, 2020.

(51) Int. Cl.
*A41D 15/04* (2006.01)
*A41D 13/11* (2006.01)

(52) U.S. Cl.
CPC ..... *A41D 15/04* (2013.01); *A41D 13/1107* (2013.01)

(58) Field of Classification Search
CPC ..... A41D 13/1107; A41D 13/1153; A41D 13/1161; A41D 15/04
See application file for complete search history.

(56) References Cited

U.S. PATENT DOCUMENTS 214,326 A * 4/1879 Troelicht ..... A42B 1/046 2/205
2,166,566 A * 7/1939 Giuseffi ..... A41D 27/18 2/98
2,839,757 A * 6/1958 Gianola ..... A42B 1/045 2/205
4,494,246 A * 1/1985 Tillbrook ..... A41D 13/012 2/24
4,771,479 A * 9/1988 Silver ..... A41D 3/00 2/93
5,115,516 A * 5/1992 Golde ..... A41D 23/00 2/84
5,115,517 A * 5/1992 Ferguson ..... A41D 23/00 2/202
5,251,336 A * 10/1993 Nevins ..... A42B 1/046 2/205
5,960,478 A * 10/1999 Sivret ..... A42B 1/046 2/202

(Continued)

FOREIGN PATENT DOCUMENTS

CN 202197862 U 4/2012
CN 203735528 U 7/2014

(Continued)

OTHER PUBLICATIONS

Product information—"New! Forest Green Long Sleeve DuNOPLs-T"; retrieved from https://www.dus-tshirt.com on Aug. 17, 2021. 3 pages.

(Continued)

*Primary Examiner* — F Griffin Hall
(74) *Attorney, Agent, or Firm* — Frost Brown Todd LLP

(57) ABSTRACT

A garment with a concealed deployable mask. The garment includes a collar joined to a garment body. The collar can have joined thereto a collar extension, the collar extension defining a pouch. A mask is disposed in the pouch, a first portion of the mask being joined to the collar extension, and a second portion of the mask has an ear attachment member.

6 Claims, 8 Drawing Sheets

(56) References Cited

U.S. PATENT DOCUMENTS

| | | | | |
|---|---|---|---|---|
| 6,226,799 | B1 * | 5/2001 | Lane | A41D 23/00 2/207 |
| 6,374,829 | B1 * | 4/2002 | Chapman | A61F 5/055 128/857 |
| 6,418,559 | B1 | 7/2002 | Wrecsics et al. | |
| 7,418,740 | B2 * | 9/2008 | Anderson | A41D 3/02 2/69 |
| 8,161,575 | B2 * | 4/2012 | Debrick | A41D 27/18 2/206 |
| 8,438,665 | B2 * | 5/2013 | Roemer | A41D 3/00 2/84 |
| 8,955,165 | B1 * | 2/2015 | Romero | A41D 23/00 2/101 |
| 9,433,245 | B2 * | 9/2016 | Elsmo | A41D 3/08 |
| 9,521,873 | B1 | 12/2016 | Mignone | |
| 10,051,901 | B2 * | 8/2018 | Peyser | A47G 9/1045 |
| 11,134,731 | B2 * | 10/2021 | Hussey | A41D 13/1161 |
| 2011/0185482 | A1 * | 8/2011 | Godfrey | A41D 13/1161 2/455 |

FOREIGN PATENT DOCUMENTS

| | | | |
|---|---|---|---|
| CN | 203873033 | U | 10/2014 |
| CN | 206949584 | U | 2/2018 |
| CN | 210226959 | U | 4/2020 |
| EP | 0627888 | A1 | 12/1994 |
| EP | 2293695 | A1 | 3/2011 |
| EP | 3325104 | A1 | 5/2018 |
| JP | 2007039827 | A | 2/2007 |
| KR | 200451355 | Y1 | 10/2012 |
| WO | 2008066510 | A2 | 6/2008 |

OTHER PUBLICATIONS

Product information—Koofin Gear—Fishing Hoodie with Face Mask Sunblock Shirt Hooded Long Sleeve with Drawstrings Pocket; retrieved from https://www.amazon.com/Performance-Fishing-Hoodie-Sunblock-Drawstrings/dp/B07R4Z764Y on Sep. 21, 2021. 1 page.

Product information—ODLO—Blackcomb Base Layer Shirt with Face Mask; retrieved from https://www.odlo.com/us/en/men%27s-blackcomb-long-sleeve-base-layer-top-with-face-mask-187092.html on Sep. 21, 2021. 5 pages.

* cited by examiner

COLLARED GARMENT WITH CONCEALED DEPLOYABLE FACE MASK

CROSS-REFERENCE TO RELATED APPLICATIONS

This application claims the benefit of U.S. Ser. No. 63/056,894, filed on Jul. 27, 2020, the disclosure of which is incorporated herein by reference in its entirety

BACKGROUND

Many individuals wear protective masks or other forms of face coverings due to concern over contraction of airborne diseases.

BRIEF DESCRIPTION OF THE DRAWINGS

It is believed that certain embodiments will be better understood from the following description taken in conjunction with the accompanying drawings, in which like references indicate similar elements and in which.

DETAILED DESCRIPTION

Figure 1:
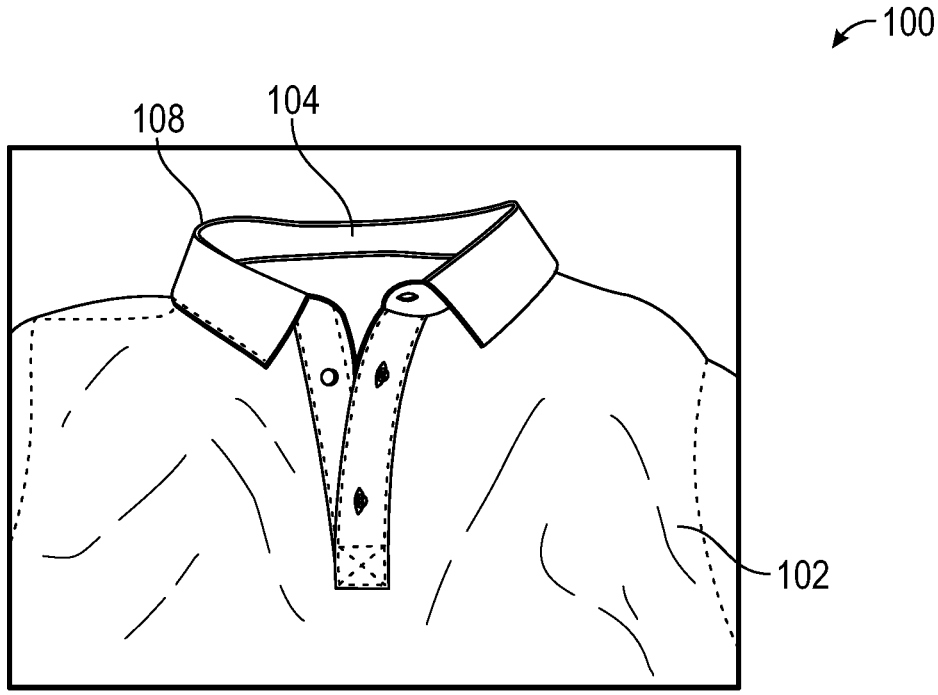
FIG. 1 depicts an example collared garment with a concealed deployable mask in accordance with a non-limiting embodiment.

Various non-limiting embodiments of the present disclosure will now be described to provide an overall understanding of the principles of the structure, function, and use of the systems and methods disclosed. One or more examples of these non-limiting embodiments are illustrated in the selected examples disclosed and described in detail with reference made to FIGS. 1-16 in the accompanying drawings. Those of ordinary skill in the art will understand that systems and methods specifically described herein and illustrated in the accompanying drawings are non-limiting embodiments. The features illustrated or described in connection with one non-limiting embodiment may be combined with the features of other non-limiting embodiments. Such modifications and variations are intended to be included within the scope of the present disclosure.

The systems and methods disclosed herein are described in detail by way of examples and with reference to the figures. The examples discussed herein are examples only and are provided to assist in the explanation of the systems and methods described herein. None of the features or components shown in the drawings or discussed below should be taken as mandatory for any specific implementation of any of these the systems or methods unless specifically designated as mandatory. In this disclosure, any identification of specific techniques, arrangements, etc. are either related to a specific example presented or are merely a general description of such a technique, arrangement, etc. Identifications of specific details or examples are not intended to be, and should not be, construed as mandatory or limiting unless specifically designated as such. Any failure to specifically describe a combination or sub-combination of components should not be understood as an indication that any combination or sub-combination is not possible.

It will be appreciated that modifications to disclosed and described examples, arrangements, configurations, components, elements, apparatuses, devices, systems, methods, etc. can be made and may be desired for a specific application. Also, for any methods described, regardless of whether the method is described in conjunction with a flow diagram, it should be understood that unless otherwise specified or required by context, any explicit or implicit ordering of steps performed in the execution of a method does not imply that those steps must be performed in the order presented but instead may be performed in a different order or in parallel.

Reference throughout the specification to "various embodiments," "some embodiments," "one embodiment," "some example embodiments," "one example embodiment," or "an embodiment" means that a particular feature, structure, or characteristic described in connection with any embodiment is included in at least one embodiment. Thus, appearances of the phrases "in various embodiments," "in some embodiments," "in one embodiment," "some example embodiments," "one example embodiment, or "in an embodiment" in places throughout the specification are not necessarily all referring to the same embodiment. Furthermore, the particular features, structures or characteristics may be combined in any suitable manner in one or more embodiments.

The systems and methods disclosed herein generally relate to collared garments that include integral masks that can be selectably deployed by a wearer. In accordance with various embodiments, the mask can be generally concealed inside the back portion of a normal garment collar such that an occasional observer would not necessarily notice the presence of the mask when in the stowed position. As used herein, a collar of a garment is the band of material around the neck of a garment that is an integral part of the garment. Further, collared garments can include any garment having a collar, such as a casual polo shirt or a dress shirt. With regard to dress shirt embodiments, the collar of the dress shirt can be, for example, a wing collar, a tab collar, a button-down collar, and so forth. FIGS. 1-16 depict example types of collared garments with example types of deployable masks in accordance with various non-limiting embodiments.

Referring now to FIGS. 1-4 there is shown an example embodiment of a garment 100 that is an example of a collared garment with a concealed deployable mask. The garment 100 can be a shirt having a body portion 102 and a collar 104. The collar 104 can be an integral part of the body portion 102, including by being stitched to the body portion 102, and surrounds the neck of a wearer when worn. The collar 104 can be a folded fabric member in which a fold crease 108 defines the top of the collar. The collar 104 is configured to have a portion housing a mask in a rolled, folded, or otherwise compressed, stowed configuration.

Figure 2:
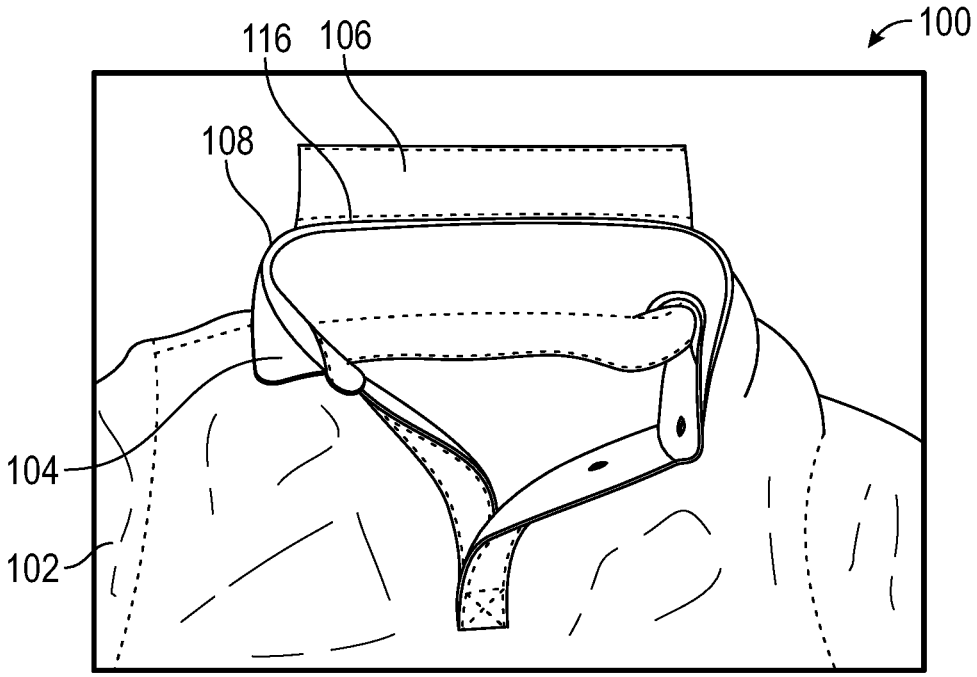
FIG. 2 depicts an example collared garment with a concealed deployable mask in accordance with a non-limiting embodiment.
Figure 3:
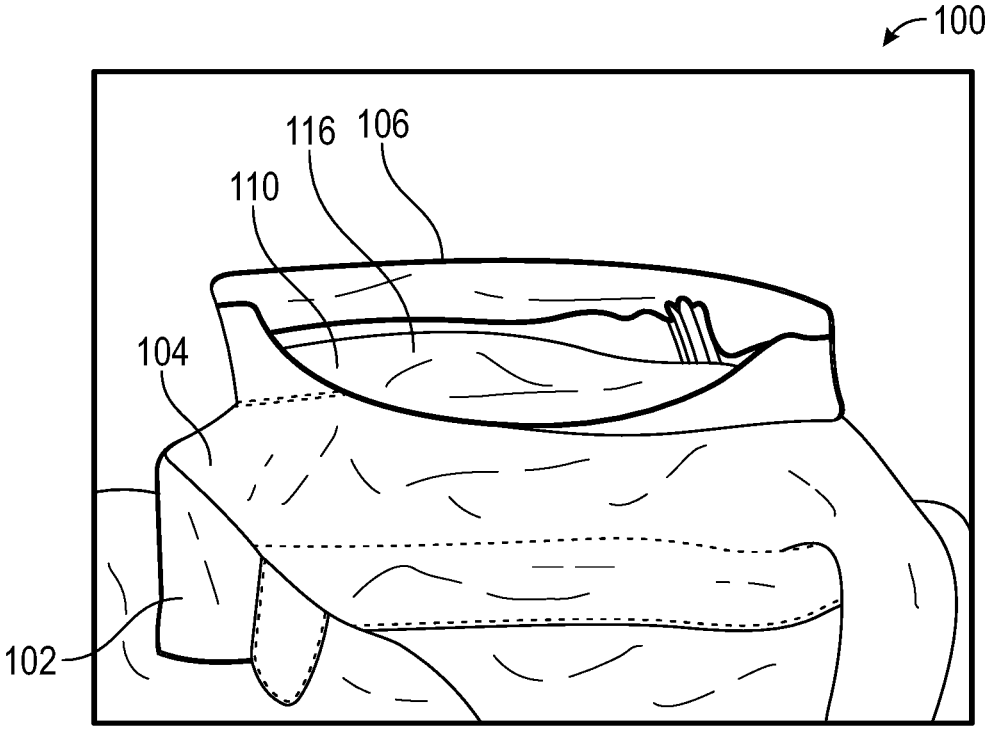
FIG. 3 depicts an example collared garment with a concealed deployable mask in accordance with a non-limiting embodiment.
Figure 4:
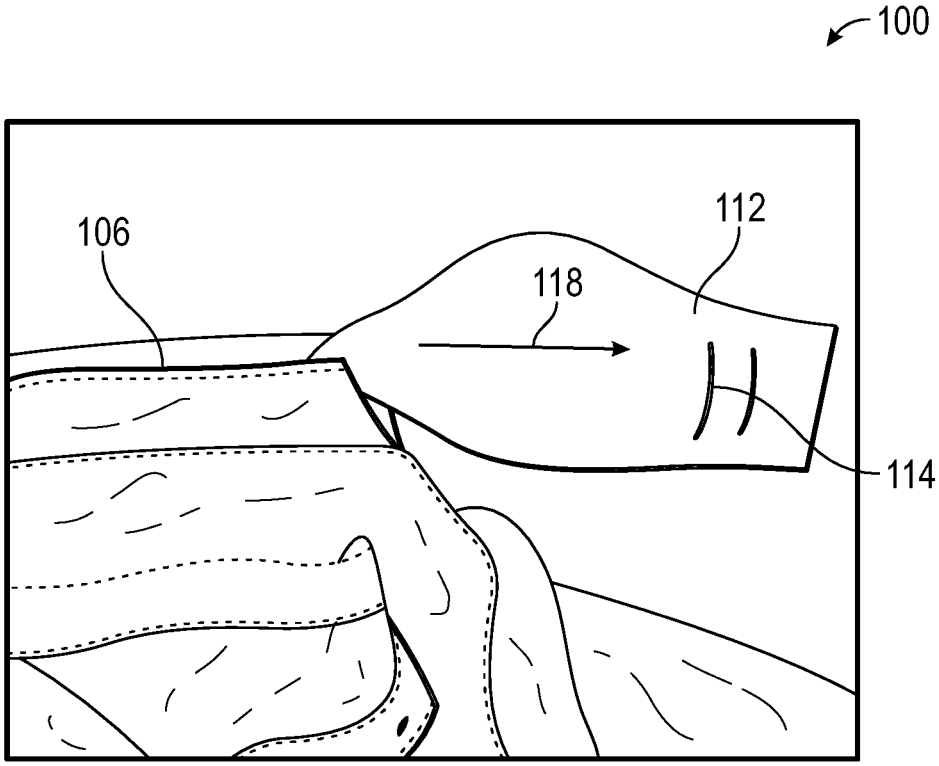
FIG. 4 depicts an example collared garment with a concealed deployable mask partially withdrawn in accordance with a non-limiting embodiment.
Figure 5:
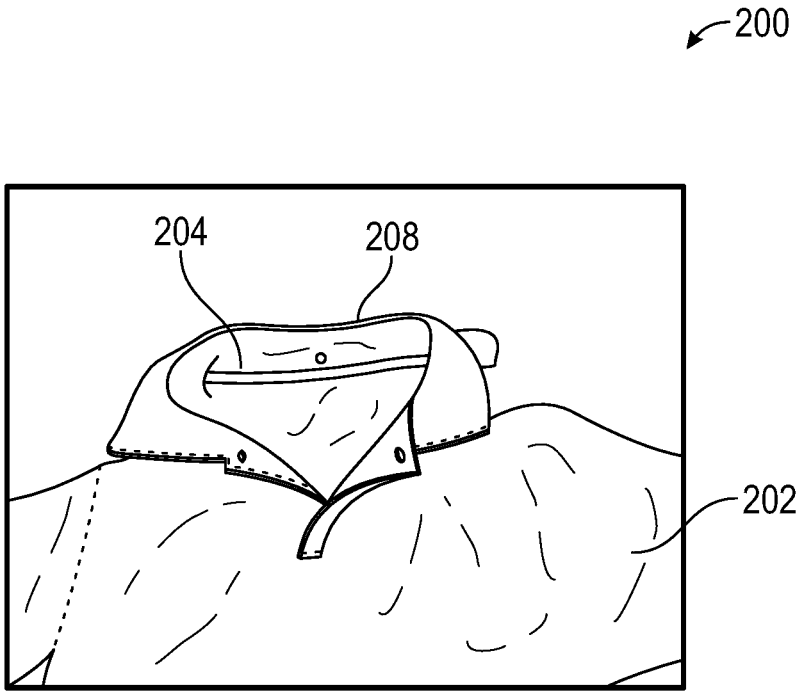
FIG. 5 depicts an example collared garment with a concealed deployable mask in accordance with a non-limiting embodiment.

As shown in FIG. 2, the collar 104 can have joined thereto a collar extension 106. The collar extension 106 can be sewed along a seam 116 of the collar 104 and can be folded along the seam 116 to be joined in a hinge-like fashion. In FIG. 2, the collar extension 106 is folded upwardly from the fold crease 108. As shown in FIGS. 3 and 4, the collar extension 106 can be, or have, a pocket or pouch-like enclosure in which is housed a mask 112. In an embodiment, the pouch-like enclosure is a pouch 110 which can be opened and closed at an opening having a closure, such as a pocket flap, buttons, snaps, a zipper, hook and loop fastener, or the like. In an embodiment, a first portion of the mask 112 is sewn onto the garment, including being sewn into the pouch 110. As shown in FIG. 4, the mask 112 can be withdrawn, such as by grasping and pulling a second portion of the mask 112, such as pulling in the direction of arrow 118 in FIG. 4. The mask 112 can be pulled sufficient to exit the pouch 110 and be configured for use across a portion of the face of a person wearing the garment 100. In an example embodiment, the second portion of the mask 112 can have an ear attachment member, such as one or more elastic loops, or one or more slots 114 that can be utilized to fix the mask in place on the face of the wearer. For example, when the garment 100 is being worn, the mask 112 can be pulled out of the pouch, around one side of the face of the wearer, and secured to the ear on the other side of the face of the wearer.

As can be understood from the above description, a method of use of the garment 100 by a person wearing the garment 100 can include the steps of donning the garment 100, accessing the pouch 110, for example by reaching back and folding up the collar extension 106, opening the pouch 110, grasping a portion of the mask 112 with one or both hands, pulling the mask 112 at least partially out of the pouch 110, suitably configuring the mask for placement across the wearer's face, securing the mask to the wearers face, such as by securing one of the wearer's ears to a slot 114 in the mask 112.

Thus, to deploy a hidden mask in accordance with present disclosure, the garment collar can first be unfolded upward from the shoulders. In accordance with various embodiments, after the collar has been unfolded, the mask can be accessible from a pouch or pocket that is sewn into the back portion of the collar. It is noted that masks described herein are not deployed from the front of the garment collar.

Referring now to FIGS. 5-8 there is shown an example embodiment of a garment 200 that is an example of a collared garment with a concealed deployable mask. The garment 200 can be a shirt having a body portion 202 and a collar 204. The collar 204 can be integral with, including being stitched to, the body portion 202 and surrounds the neck of a wearer when worn. The collar 204 can be a folded fabric member in which the fold crease 208 defines the top of the collar, from which downwardly extends a collar flap 206 (when worn as a shirt). When the mask of the garment 200 is not being utilized, the collar flap 206 can be secured in its folded down configuration by suitable connectors, such as buttons, snaps, a zipper, hook and loop fastener, or the like.

Figure 6:
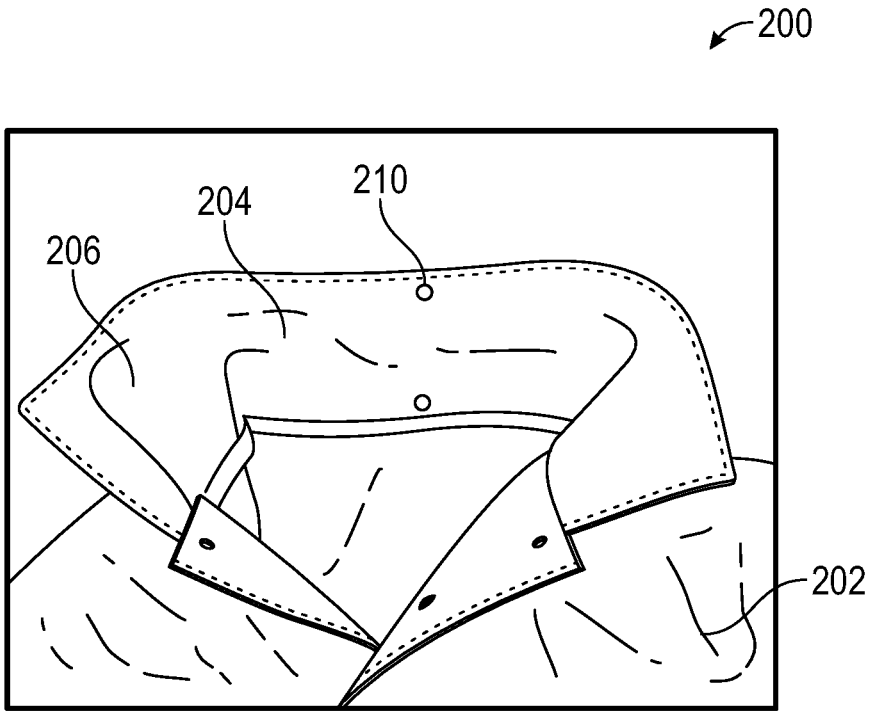
FIG. 6 depicts an example collared garment with a concealed deployable mask with the collar partially unfolded in accordance with a non-limiting embodiment.
Figure 7:
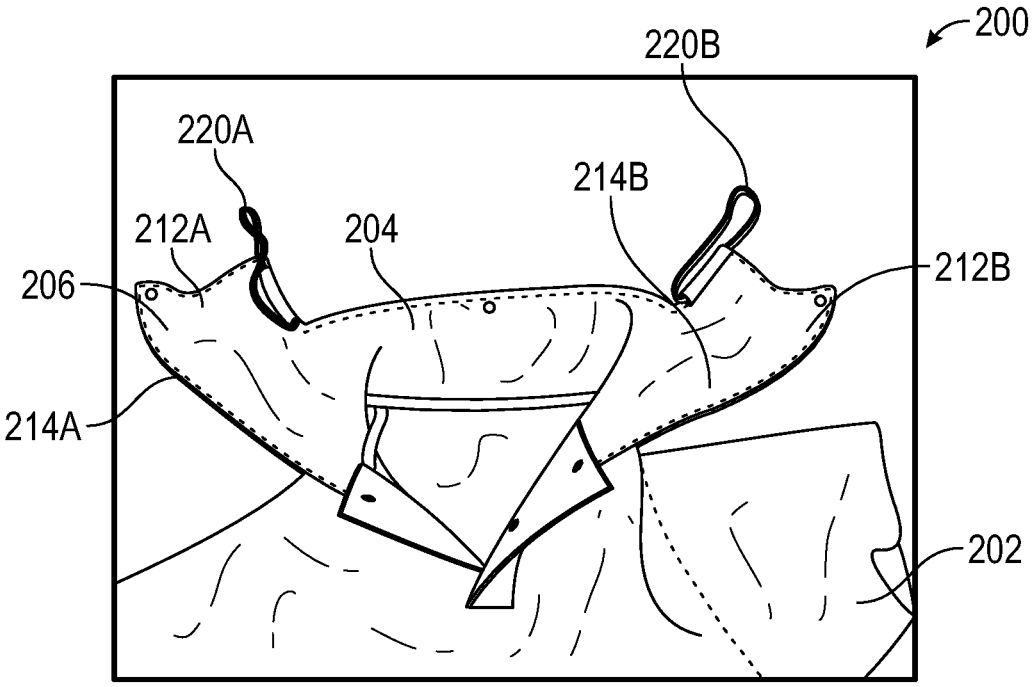
FIG. 7 depicts an example collared garment with a concealed deployable mask with the collar fully unfolded in accordance with a non-limiting embodiment.
Figure 8:
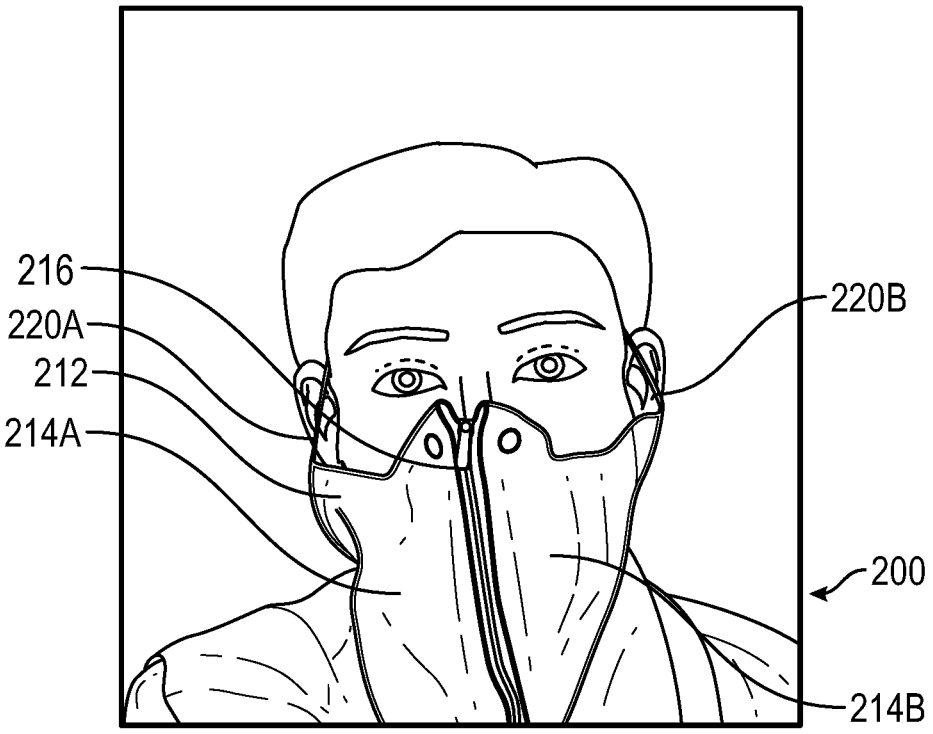
FIG. 8 depicts an example collared garment with a concealed deployable mask with the mask deployed over the face of a wearer in accordance with a non-limiting embodiment.
Figure 9:
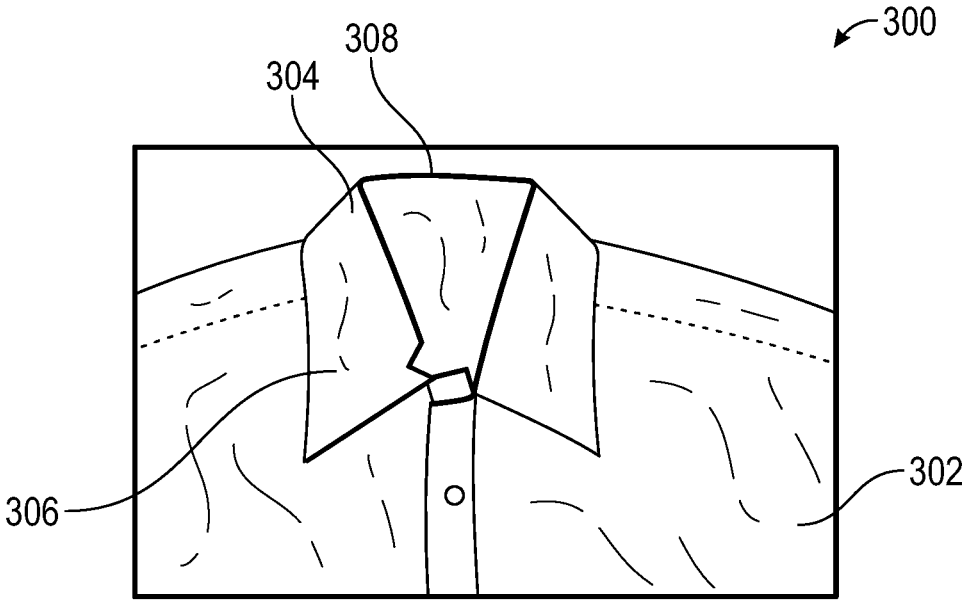
FIG. 9 depicts an example collared garment with a concealed deployable mask in accordance with a non-limiting embodiment.

As shown in FIG. 6, the collar flap 206 can be unfolded, or rolled up, with respect to collar 204, for example, by folding up, or, if there the collar flap 206 is secured in place, by unsecuring it and folding it up. In FIG. 6 there is depicted an embodiment in which the collar flap 206 is secured in place by a snap 210. As depicted in FIG. 7, the collar flap 206 can be further unfolded, unrolled, or otherwise extended to expose two portions, such as two halves, of a mask 212. In an embodiment, a first mask half 212A extends from a first side of the collar flap 206 and a second mask half 212B extends from a second, opposite, side of the collar flap 206. The first mask half 212A has a first peripheral edge 214A suitably sized and shaped to join with a second peripheral edge 214B of the second mask half 212B, as depicted in FIG. 8. The first peripheral edge 214A and the second peripheral edge 214B can be joined to configure the mask 212 by a suitable joining member 216, such as a zipper, hook and loop fastener, and the like. As depicted in FIG. 8, the joining member 216 is a zipper.

Further with reference to FIGS. 7 and 8, in an embodiment, the first mask half 212A can have joined thereto a first flexible loop 220A and the second mask half 212B can have joined thereto a second flexible loop 220B, each of which can be utilized to secure the mask 212 to the ears of the wearer, as depicted in FIG. 8. In an embodiment one or both of the first flexible loop 220A and the second flexible loop 220B can be flexible fabric and can be elastic bands.

As can be understood from the above description, a method of use of the garment 200 by a person wearing the garment 200 can include the steps of donning the garment 200, reaching behind the neck to unfold the collar flap 206 sufficiently to expose the first peripheral edge 214A and the second peripheral edge 214B of the first mask half 212A and the second mask half 212B, respectively. The first mask half 212A and the second mask half 212B is suitably configured for placement across the wearer's face. The wearer then secures the mask to the wearers face, such as by joining the two mask halves by utilizing a joining member, such as a zipper. Optionally, the wearer can secure a flexible loop joined to the mask flaps to his or her ears.

Thus, in accordance with some embodiments, the mask may be accessible by rolling or folding into and out of the collar, as shown in FIGS. 5-8, for example. In some embodiments, the mask may be folded flatly into the back portion of the collar. Once the collar is folded up from the shoulders, the mask may be further deployed by folding it out from the collar, and suitably wrapping and securing it around the face of the wearer.

Referring now to FIGS. 9-14 there is shown an example embodiment of a garment 300 that is an example of a collared garment with a concealed deployable mask. The garment 300 can be a shirt having a body portion 302 and a collar 304. The collar 304 can be stitched to the body portion 302 and surrounds the neck of a wearer when worn. The collar 304 can be a folded fabric member in which the fold crease 308 defines the top of the collar, from which downwardly extends a collar flap 306 (when worn as a shirt). When the mask of the garment 300 is not being utilized, the collar flap 306 can be secured in its folded down configuration by suitable connectors, such as buttons, snaps, a zipper, hook and loop fastener, or the like.

Figure 10:
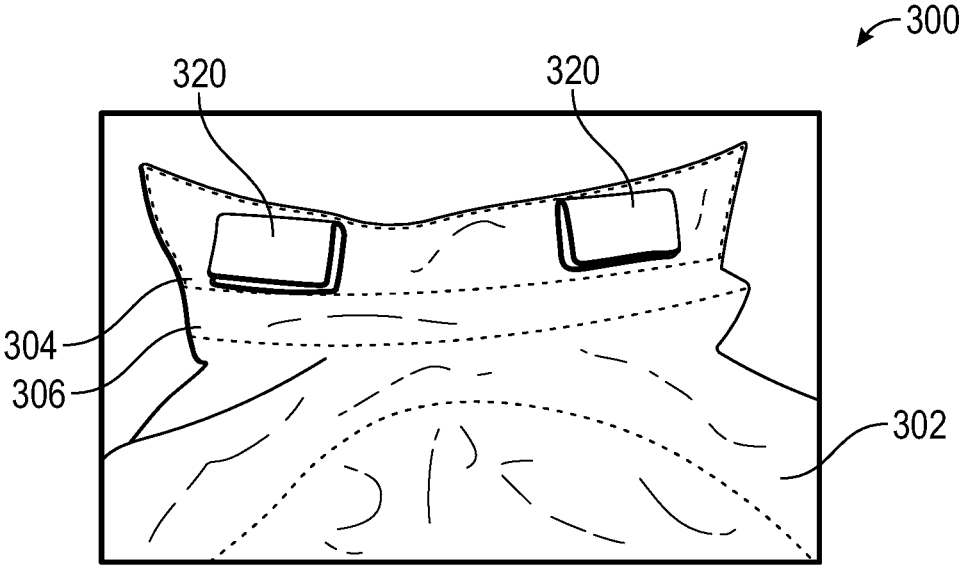
FIG. 10 depicts an example collared garment with a concealed deployable mask with the collar partially unfolded in accordance with a non-limiting embodiment.

The collar flap 306 can have multiple folds to secure wing-like collar flap extensions that can be suitably sized and shaped to configure a mask on the face of a wearer. As shown in FIG. 10, the collar flap 306 can be unfolded, or rolled up, with respect to collar 304, for example, by folding up, or, if the collar flap 306 is secured in place, by unsecuring it and folding it up. Components of the mask, including the wing-like flap extensions can be secured in place by securing members, such as hook and loop fasteners 320.

Figure 11:
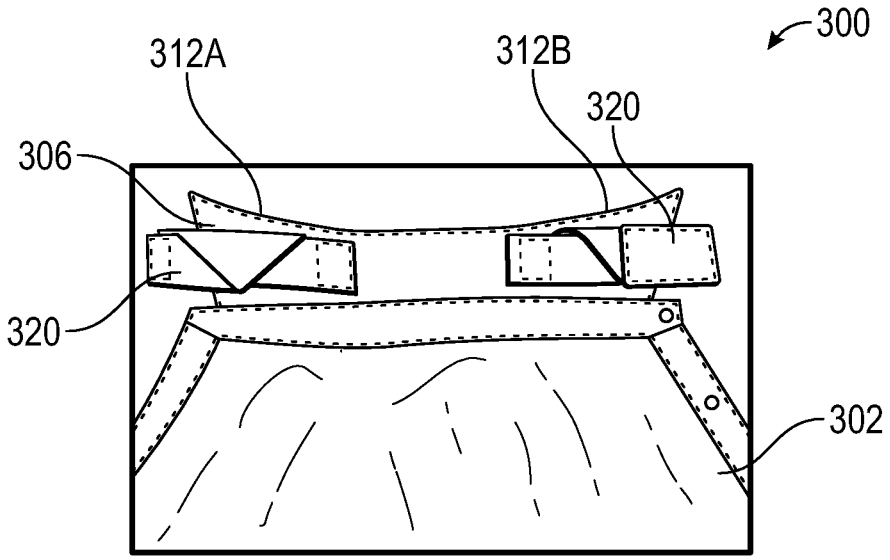
FIG. 11 depicts an example collared garment with a concealed deployable mask with the collar partially unfolded in accordance with a non-limiting embodiment.

Referring now to FIG. 11, the hook and loop fasteners 320 are released, and the collar flap 306 can be further unfolded, unrolled, or otherwise extended to expose two folded portions, such as two folded halves, of a mask 312. In an embodiment, a first folded mask half 312A extends from a first side of the collar flap 306 and a second folded mask half 312B extends from a second, opposite, side of the collar flap 306.

Figure 12:
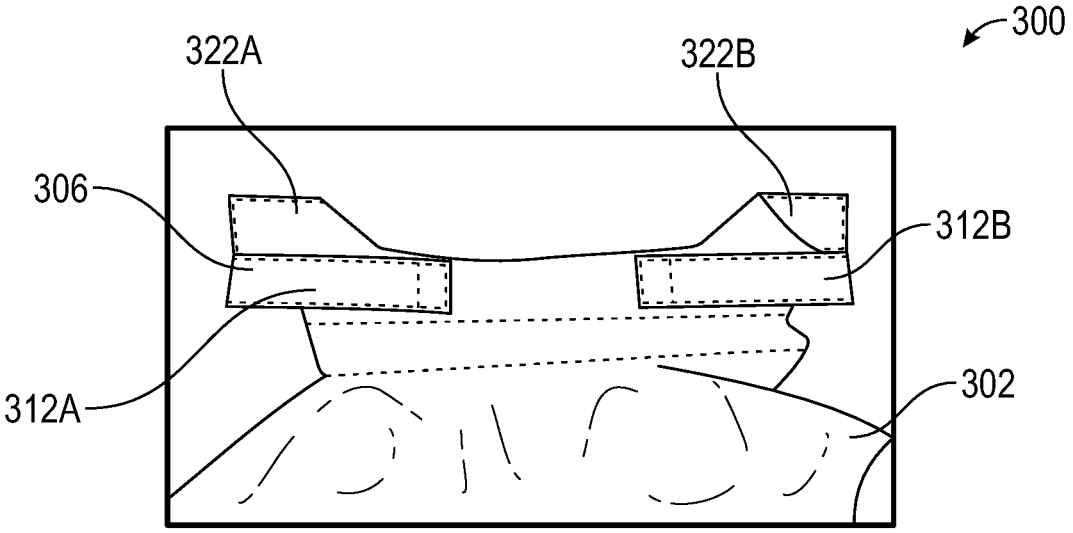
FIG. 12 depicts an example collared garment with a concealed deployable mask with the collar partially unfolded in accordance with a non-limiting embodiment.
Figure 14:
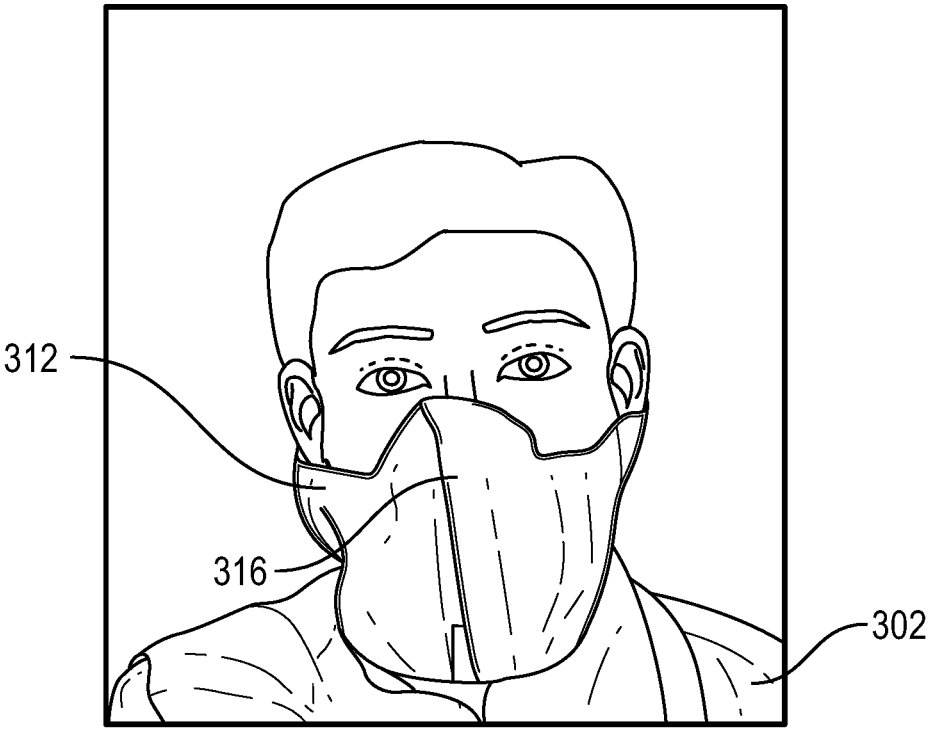
FIG. 14 depicts an example collared garment with a concealed deployable mask with the mask deployed over the face of a wearer in accordance with a non-limiting embodiment.
Figure 15:
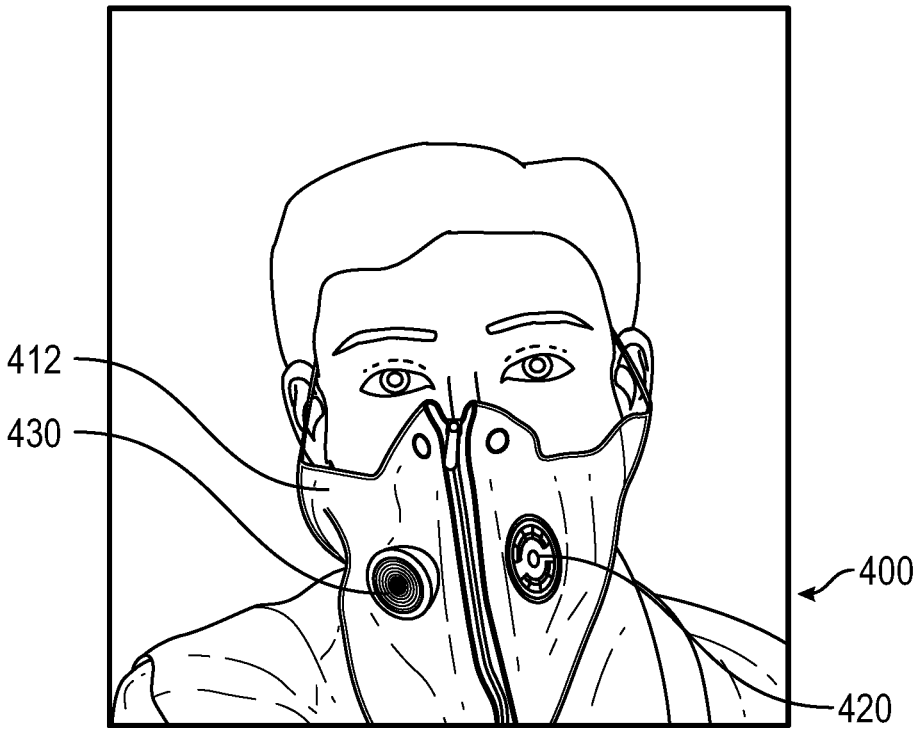
FIG. 15 depicts an example collared garment with a concealed deployable mask with the mask deployed over the face of a wearer in accordance with a non-limiting embodiment.

Referring now to FIG. 12, the first folded mask half 312A and the second folded mask half 312B can be further unfolded to expose a first mask wing 322A and a second mask wing 322B extending from the first folded mask half 312A and the second folded mask half 312B, respectively. A further folded portion can be extended, as depicted in FIG. 14. As shown, a first mask wing extension 324A can extend from the first mask wing 322A, and a second mask wing extension 324B can extend from the second mask wing 322B.

Figure 13:
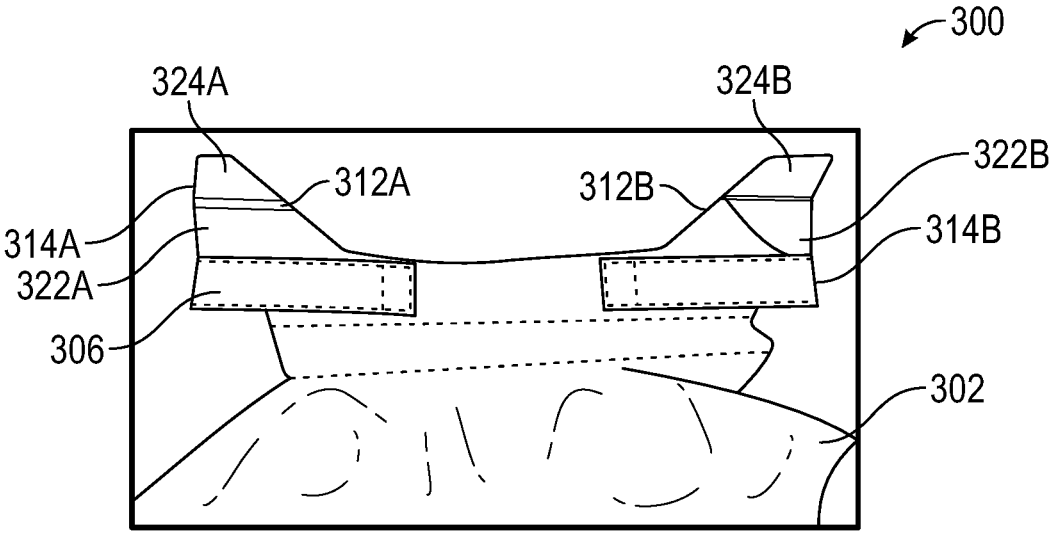
FIG. 13 depicts an example collared garment with a concealed deployable mask with the collar fully unfolded in accordance with a non-limiting embodiment.

Once fully unfolded, a first folded mask half 312A has a first peripheral edge 314A suitably sized and shaped to join with a second peripheral edge 314B of the second folded mask half 312B, as depicted in FIG. 13. The first peripheral edge 314A and the second peripheral edge 314B can be joined to configure the mask 312 by a suitable joining member 316, such as a zipper, hook and loop fastener, and the like. As depicted in FIG. 14, the joining member 316 is a hook and loop fastener.

As can be understood from the above description, a method of use of the garment 300 by a person wearing the garment 300 can include the steps of donning the garment 300, reaching behind the neck to unfold the collar flap 306 sufficiently to expose the first peripheral edge 314A and the second peripheral edge 314B of the first folded mask half 312A and the second folded mask half 312B, respectively. The first folded mask half 312A and the second folded mask half 312B is suitably configured for placement across the wearer's face. The wearer then secures the mask to the wearer's face, such as by joining the two mask halves by utilizing a joining member, such as a hook and loop fastener.

Thus, in accordance with some embodiments, the mask may be folded flatly into the back portion of the collar. Once the collar is folded up from the shoulders, the mask may be further deployed by folding it out from the collar, and suitably wrapping and securing it around the face of the wearer. Furthermore, in some embodiments, once the mask is folded out it can have wings that can be selectably unfolded by the wearer to increase the coverage of the mask. Example wings in accordance with one embodiment are shown in FIGS. 13 and 14.

In accordance with the present disclosure, the mask can wrap around the face, as opposed to being pulled upward from the front of the collar. As disclosed herein, the mask can have left and right sides that can require attachment to each other in the front attachment technique, such as using a zipper, a button, a hook and loop fastener, and so further. The mask can be a fabric material, a nonwoven material, a breathable polymer, and combinations thereof.

Furthermore, the dimensions of masks in accordance with the present disclosure can be adjustable to fit different size faces. In some embodiments, the mask may be attached to ears with loops. In other embodiments, the mask may be attached to ears with slits cut into the side of the mask. In some implementations, the mask can cover the wearer's ears when in the deployed position. The mask can also include a pouch or dual pouches in a front region to hold a filter, which can be a removable filter.

When the user wishes to stow the mask, the mask can be returned to the storage position in the collar. In some embodiments, it can be returned to the collar pocket or pouch. In other embodiments, it can be stowed by rolling it back into the collar or folding it back into the collar in a flat storage configuration. In some embodiments, the mask can be secured under the back of the collar by a closure, such as a snap, a hook and loop fastener, or other suitable fastener. In some embodiments, a masks in accordance with the present disclosure can be retrofitted to an existing collared garment.

Figure 16:
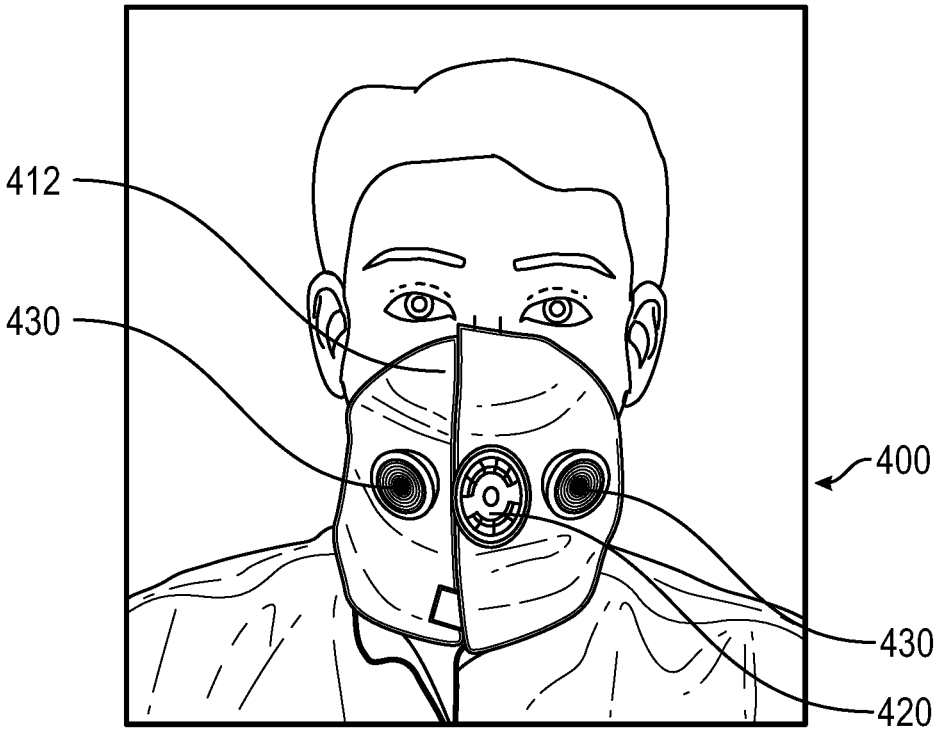
FIG. 16 depicts an example collared garment with a concealed deployable mask with the mask deployed over the face of a wearer in accordance with a non-limiting embodiment.

In any of the above-disclosed embodiments the mask of the garment can optionally include various components useful for improving mask performance. For example, referring to FIGS. 15-16, there is shown example embodiments of a garments 400 can have any or all of the features described for garments above, and are additional examples of a collared garment with a concealed deployable mask 414 having a pocket, pouch, or the like, for containing in a suitably operable position various components. As shown, in an embodiment a mask 414 can have one or both of a filter 420 and a voice amplifier 430. In an embodiment, as shown in FIG. 16, a mask 414 can have more than one of a filter 420 and/or a voice amplifier 430; the embodiment of FIG. 16 has two voice amplifiers 430 and one filter 420. The filter 420 can be any of known filters suitable for face masks, and can include an N95 filter, HEPA filter, and the like. The voice amplifier 430 can include a speaker member that amplifies the voice of the wearer while wearing the mask 412. The voice amplifier can include components suitable for detecting the wearer's voice and then intelligently reproducing it through the speaker member. In an embodiment, the voice amplifier can connect via Bluetooth to an electronic device, such as a smartphone or tablet. The electronic device can have app configured to enable control of voice amplifier features such as volume control, as well as transcribe speech into text messages, make calls, or amplify the mask wearer's voice though the electronic device speaker.

These and other embodiments of the systems and methods can be used as would be recognized by those skilled in the art. The above descriptions of various systems and methods are intended to illustrate specific examples and describe certain ways of making and using the systems disclosed and described here. These descriptions are neither intended to be nor should be taken as an exhaustive list of the possible ways in which these systems can be made and used. A number of modifications, including substitutions of systems between or among examples and variations among combinations can be made. Those modifications and variations should be apparent to those of ordinary skill in this area after having read this disclosure.

What is claimed is:

1. A garment with a concealed deployable mask, the garment comprising:

a collar joined to a garment body, the collar having joined thereto a collar flap, the collar flap having an outer side and an underside, the underside having a first side and a second side;

a first mask half joined to and extending from the first side of the underside of the collar flap and a second mask half joined to and extending from the second side of the underside of the collar flap, wherein the collar flap is movable between a folded down position and an unfolded position, wherein in the folded down position the collar flap is securable to the garment body by connectors and the first mask half and the second mask half are concealed from view;

the first mask half having a plurality of parallel folds that, when folded, the first mask half is substantially flat and securable to the underside of the collar flap by a first connector, and, when unfolded, the first mask half defines a first wing-like flap extending laterally from the collar flap in a first direction and having a first peripheral edge, the second mask half having a plurality of parallel folds that, when folded, the second mask half is substantially flat and securable to the underside of the collar flap by a second connector, and, when unfolded, the second mask half defines a second wing-like flap extending laterally from the collar flap in a second direction opposite to the first direction and having a second peripheral edge, and wherein the first peripheral edge of the first mask half and the second peripheral edge of the second mask half each have a respective joining member and which, upon joining the respective joining members, the first mask half and the second mask half define a mask.

2. The garment of claim 1, wherein the collar flap is sewn onto the collar to define a hinged connection.

3. The garment of claim 1, wherein the respective joining members collectively comprise a hook and loop fastener.

4. The garment of claim 1, wherein when joined, the mask has a sufficient size and shape to cover the nose and mouth of the wearer of the garment.

5. The garment of claim 1, wherein the first mask half and the second mask half are each made of a material selected from woven fabrics, nonwoven fabrics, breathable polymers, and combinations thereof.

6. The garment of claim 1, wherein the connectors are any of buttons, snaps, hook and loop fasteners.

* * * * *